US008637443B2

(12) United States Patent
Basu et al.

(10) Patent No.: US 8,637,443 B2
(45) Date of Patent: Jan. 28, 2014

(54) CLEANING COMPOSITIONS AND METHODS COMPRISING A HYDROFLUORO-OLEFIN OR HYDROCHLOROFLUORO-OLEFIN SOLVENT

(75) Inventors: Rajat Basu, Morristown, NJ (US); Gary Zyhowski, Morristown, NJ (US); Kane Cook, Morristown, NJ (US); David Nalewajek, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/140,176

(22) PCT Filed: Dec. 17, 2009

(86) PCT No.: PCT/US2009/068588

§ 371 (c)(1),
(2), (4) Date: Aug. 30, 2011

(87) PCT Pub. No.: WO2010/080544

PCT Pub. Date: Jul. 15, 2010

(65) Prior Publication Data

US 2012/0015863 A1 Jan. 19, 2012

Related U.S. Application Data

(60) Provisional application No. 61/138,164, filed on Dec. 17, 2008.

(51) Int. Cl.
*C11D 3/24* (2006.01)

(52) U.S. Cl.
USPC ..... 510/400; 510/276; 510/285; 510/286; 510/287; 510/299; 510/304; 510/412; 510/517; 510/528

(58) Field of Classification Search
USPC ..... 510/276, 285, 286, 287, 299, 304, 400, 510/412, 517, 528; 442/93, 94
See application file for complete search history.

(56) References Cited

U.S. PATENT DOCUMENTS

| | | | | |
|---|---|---|---|---|
| 5,424,438 | A * | 6/1995 | Chittofrati et al. | 546/336 |
| 8,114,828 | B2 * | 2/2012 | Bowman et al. | 510/412 |
| 2007/0276068 | A1 * | 11/2007 | Hintzer et al. | 524/284 |
| 2008/0033063 | A1 * | 2/2008 | Hoshikawa et al. | 516/77 |
| 2010/0102272 | A1 * | 4/2010 | Basu et al. | 252/182.12 |
| 2012/0141385 | A1 * | 6/2012 | Bowman et al. | 424/45 |

* cited by examiner

*Primary Examiner* — Charles Boyer
(74) *Attorney, Agent, or Firm* — Colleen D. Szuch

(57) ABSTRACT

The invention provides solvent and cleaning compositions comprising an ionic surfactant, which preferably has a fluorinated portion thereof, and a solvent selected from hydrofluoro- and/or hydrochlorofluoro-olefins. Additionally, the invention provides drying, dry cleaning, and soil repellency compositions containing a hydrofluoro- or hydrochlorofluoro-olefin and said surfactant. Additionally, the invention provides drying compositions containing a hydrofluoro-olefin or hydrochlorofluoro-olefin and an alcohol such as methanol, ethanol or isopropanol.

23 Claims, No Drawings

CLEANING COMPOSITIONS AND METHODS COMPRISING A HYDROFLUORO-OLEFIN OR HYDROCHLOROFLUORO-OLEFIN SOLVENT

CROSS REFERENCE TO RELATED APPLICATIONS

The present invention is a national phase application which is related to and claims the priority benefit of International Application No. PCT/US09/68588, filed Dec. 17, 2009, which claims priority benefit of U.S. Provisional Application No. 61/138,164 filed on Dec. 12, 2008, each of which is incorporated herein in its entirety by reference.

FIELD OF THE INVENTION

The invention relates to cleaning and/or dewatering compositions and methods.

BACKGROUND OF THE INVENTION

The use of aqueous compositions for the surface treatment of metal, ceramic, glass, and plastic articles is well known. Additionally, cleaning, plating, and deposition of coatings on the surface of articles are known to be carried out in aqueous media. In both cases, a halocarbon solvent and a hydrophobic surfactant may be used to displace water from a water-laden surface.

A variety of solvent-surfactant drying compositions for water displacement have been utilized. For example, solvent-surfactant compositions based on 1,1,2trichlorotrifluoroethane ("CFC-113") are known. However, environmental concerns are leading to a decline in the use of such CFC-based systems.

Applicants have come to recognize that it is generally not possible to predict whether a particular surfactant or group of surfactants will be fully acceptable for use with a given solvent or group of solvents, including hydrochlorofluorocarbons ("HCFC's"), hydrofluorocarbons ("HFC's"), hydrochlorofluoro-olefins ("HCFO's") and hydrofluoro-olefins ("HFO's") and hydrofluoroethers ("HFE's") solvents suitable to replace CFC solvents. Moreover, many of the known surfactants cannot be dissolved in such solvents. Further, dry cleaning, drying, and water displacement require surfactants that, together with the chosen solvent, impart distinct, and a difficult to achieve set of properties to the cleaning compositions. For the removal of oil from machined parts, the surfactant will preferably aid in the removal of the soils that would otherwise only be sparingly soluble in such solvents. Additionally, water displacement requires a surfactant that does not cause the formation a stable emulsion with water.

Applicants have come to appreciate that halogenated olefin solvents in general, and chloro-fluoro-olefins in particular, present the additional difficulty of identifying combinations of such solvents and surfactants that not only possess the desired solvency and other properties, but which also exhibit an acceptable level of stability since olefins are generally understood to be reactive, especially in comparison to many previously used solvents.

Therefore, one must not only identify those surfactants soluble in the HCFC, HFC, HCFO, HFO, or HFE solvent selected, but also surfactants that also have the desired activity in the solvents and which exhibit acceptable levels of stability.

SUMMARY OF THE INVENTION

Aspects of the present invention are directed to compositions containing hydrohaloolefins, any preferred embodiments the compositions comprising hydrochlorofluoro-olefin (HCFO) and/or hydrofluoro-olefin (HFO), and certain fluorine-containing surfactants which exhibit superior and/or surprisingly unexpected results when used in combination with the selected hydrohaloolefins. For example, preferred compositions of the present invention have the preferred property of comprising a surfactant which is soluble in the hydrohaloolefin, and in particular the HFO and/or HCFO, while at the same time forming a combination that exhibits a relatively high level of stability. In preferred embodiments, the combination of the selected HHO(s) and the selected surfactant(s) form a composition which exhibits a desirable level of surface activity and which are preferably useful in displacing water.

Further aspects of the present invention are directed to compositions containing hydrochlorofluoro-olefin (HCFO) and/or hydrofluoro-olefin (HFO) with at least one alcohol, in particular methanol, ethanol, or isopropanol.

Further aspects are directed to the use of the compositions disclosed herein for drying, dry cleaning, and soil repellency.

DETAILED DESCRIPTION OF THE INVENTION

The present invention is directed to surfactants that may be used with halo-olefin solvents, including hydrochlorofluoro-olefins (HCFOs) and hydrofluoro-olefins (HFOs). The surfactants useful in the invention are hydrophobic, fluorine-containing surfactants soluble in the HFO and/or HCFO.

In preferred embodiments of the invention, the surfactant comprises, and preferably comprises in major proportion, and more preferably in certain embodiments consists essentially of, an ionic surfactant having a cationic portion and an anionic portion. In preferred embodiments the cationic portion of the surfactant preferably includes a fluorocarbon moiety, and even more preferably a fluoroalkyl moiety. Of course it will be understood that in such preferred embodiments the anionic portion of the surfactant may also include a fluorocarbon moiety. As used herein, the term fluorocarbon moiety is intended in its broad sense to mean a group of covalently bonded atoms that include at least one carbon-carbon bond and at least one fluorine attached to a carbon atom in the group.

In certain highly preferred embodiments the preferred fluorocarbon moiety contained in the cationic portion of the surfactant contains a hetero-atom, and preferably the cationic portion of the surfactant comprises a fluorocarbon moiety covalently bound to a hetero-atom which is part of the ring structure in a cyclic or aromatic moiety, with the hetero atom preferably selected from the group consisting of oxygen, nitrogen or sulfur, with nitrogen been preferred in certain embodiments. Furthermore, especially in such preferred embodiments in which the cationic portion of the surfactant contains a hetero-atom covalently bound to a fluorocarbon moiety, the anionic portion of the surfactant preferably is a phosphate. In certain highly preferred embodiments, the fluorocarbon moiety of the cationic portion of the surfactant comprises a perfluoroalkyl chain linked to the hetero-atom of a cyclic or aromatic moiety. Although it is contemplated that the length of the carbon chain of the fluorocarbon moiety may vary widely within the scope of the present invention, in certain preferred embodiments, especially embodiments in which the fluorocarbon moiety is a perfluoroalkyl chain linked to the hetero-atom of a cyclic or aromatic moiety, the number of carbon atoms in the chain, and preferably a perfluoroalkyl chain, is preferably from about 2 to 30, more preferably from about 2 to about 20 and even more preferably from about 2 to about 15.

Surfactants useful in accordance with the instant invention include surfactants described in U.S. Pat. No. 5,856,286 which is hereby incorporated by reference in its entirety. In preferred embodiments, the surfactant to be used the present compositions is selected from the surfactants in accordance with formula I or formula II:

I

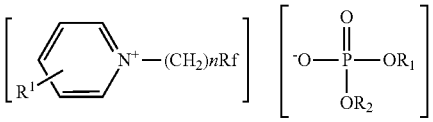

II

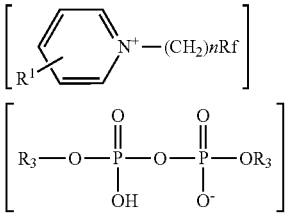

wherein $R^1$ is hydrogen, $C_1$-$C_5$ alkyl, aryl, alkylaryl, $C_1$-$C_5$ fluoroalkyl, fluoroaryl, or fluoroalkylaryl, $R_1$, $R_2$, and $R_3$ may be the same or different and are hydrogen, linear or branched $C_1$-$C_{16}$ alkyl, fluoroalkyl, aryl or alkylaryl or

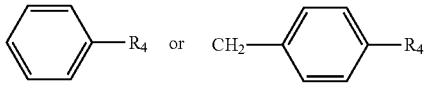

wherein $R_4$ is a linear or branched $C_1$-$C_{16}$ alkyl or fluoroalkyl group, provided that not more than one of the $R_1$, $R_2$, and $R_3$ groups is hydrogen, n is 1 to 16, and Rf is a fluorocarbon moiety, preferably $C_mF_{2m+1}$ wherein m is 2, 4, 6, 8, 10 or 12, or mixtures of such surfactants. Preferably, n is 2, 3, or 4. More preferably, n is 2 and Rf is alphafluoropolydifluoromethylene with an average m value of 6-8. Rf═$F(CF_2)_x$. A suitable distribution may contain the following: Rf—$C_4F_9$-4% max; $C_6F_{13}$-50±3%; $C_8F_{17}$-29±2%; $C_{10}F_{21}$-11±2%; and $C_{14}F_{29}$-2% max. For example, the average Rf is 7.3%, average molecular weight is 553, and average % F content is 56%.

Especially preferred heteroaromatic surfactants are the oligomeric perfluoroalkylpyridinium salts of 4-tert-octylphenyl-mono- and or di-acid phosphates. Surfactants in which the placement of the fluorinated component is on the hetero atom, i.e. the nitrogen of the pyridine ring, will generally tend to exhibit drying activity.

Other surfactants are disclosed in U.S. Pat. No. 5,610,128 which is hereby incorporated by reference in its entirety. Such surfactants are selected from formula III or formula IV:

III

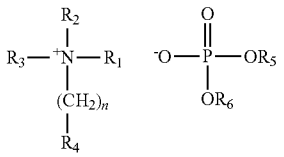

-continued

IV

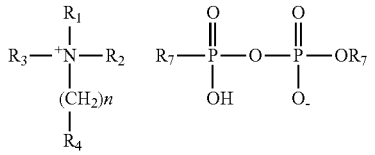

wherein $R_1$, $R_2$, $R_3$, can be the same or different and are linear or branched $C_1$ to $C_{16}$ alkyl, fluoroalkyl, alkylaryl or

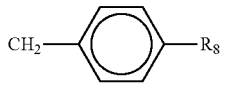

where Rs is hydrogen or a linear or branched Cl to Cl6 alkyl or fluoroalkyl group; ~is Cl to ClS perfluoroalkyl; n is from 1 to 4; Rs, ~and $R_7$ can be the same or different and are H, linear or branched $C_1$ to $C_{16}$ alkyl, fluoroalkyl or alkylaryl group or

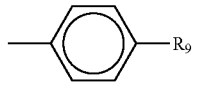

where $R_9$ is a linear or branched a $C_1$ to $C_{16}$ alkyl or fluoroalkyl group provided not more than one of $R_5$, $R_6$ and $R_7$ is H, and mixtures of such surfactants.

In certain especially preferred embodiments, the surfactant contains a portion, and preferably a cationic portion, that comprises an aromatic moiety, and preferably a moiety having at least one aromatic ring having a hetero-atom, preferably nitrogen, in the ring. Examples of such aromatic-containing surfactant for use in the practice of this invention include dimethylbenzyl 1,1,2,2tetrahydroperfluorodecylamine salt of 4-tert-octylphenyl (mono- and di-) acid phosphate; and diethylmethyl 1,1,2,2 tetrahydroperfluorodecylamine salt of 4-tert-octyl(mono- and di-) acid phosphate.

In preferred embodiments the invention is directed to compositions comprising a halogenated olefin, preferably selected from HFO, HCFO and combinations of these, at least one ionic surfactant, preferably at least one hydrophobic, fluorine-containing surfactants readily soluble in the HFO and/or HCFO. In preferred embodiments the HFO or HCFO and surfactant are present in relative proportions that provide an effective drying, dry cleaning, or soil repellency composition.

In one aspect, the invention provides a composition comprising a solvent comprising a hydrochlorofluoro-olefin, hydrofluoro-olefin, or mixtures thereof, and a surfactant of the above formulae wherein the components are present in amounts sufficient to provide effective drying or dry cleaning. The preferred solvent-surfactant compositions of the invention effectively displace water from a broad range of substrates including, without limitation: metals, such as stainless steel, aluminum alloys, and brass; glass and ceramic surfaces, such as glass, borosilicate glass and unglazed alumina; silica, such as silicon wafers; fired alumina; and the like. Further, the compositions of the invention either do not form noticeable emulsions with the displaced water or form only insignificant amounts of such emulsions.

In certain embodiments, the invention provides solvent-surfactant compositions useful in, and their use in, processes for treating fabric to impart soil repellency. The compositions comprise a solvent comprising a hydrochlorofluoro-olefin, hydrofluoroolefin, or mixtures thereof and a surfactant of the above formulae wherein the components are present in amounts sufficient to provide effective soil repellency. These compositions promote soil removal and, when present in a rinse stage, impart soil repellency.

The fluorine-containing surfactants of the invention may be prepared, for example, according to the schemes identified in U.S. Pat. No. 5,856,286 and U.S. Pat. No. 5,610,128 (already incorporated by reference). Other compounds within the surfactant class may be prepared analogously. For the surfactants not specifically shown, modifications to this scheme for their manufacture will be readily apparent to one ordinarily skilled in the art.

By hydrochlorofluoro-olefins is meant any hydrohalocarbon with chlorine and fluorine atoms attached to any of the carbons and anyone of the carbon-carbon bonds being a double bond. By hydrofluoro-olefins is meant any hydrohalocarbon with fluorine atoms attached to any of the carbons and anyone of the carbon-carbon bonds being a double bond.

Suitable hydrochlorofluoro-olefins and hydrofluoro-olefins comprise compounds having the structure of formula (A):

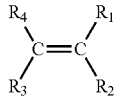

A wherein $R_1$, $R_2$, $R_3$, and $R_4$ are each independently selected from the group consisting of: H, F, Cl, and $C_1$-$C_6$alkyl, at least $C_6$aryl, in particular $C_6$-$C_{15}$aryl, at least $C_3$ cycloalkyl, in particular $C_6$-$C_{12}$cycloalkyl, and $C_6$-$C_{15}$alkylaryl, optionally substituted with at least one F or Cl wherein formula (A) contains at least one F, and preferably at least one Cl.

Suitable alkyls include, but are not limited to, methyl, ethyl, and propyl. Suitable aryls include, but are not limited to phenyl. Suitable alkylaryl include, but are not limited to methyl, ethyl, or propyl phenyl; benzyl, methyl, ethyl, or propyl benzyl, ethyl benzyl. Suitable cycloalkyls include, but are not limited to, methyl, ethyl, or propyl cyclohexyl. Typical alkyl group attached (at the ortho, para, or meta positions) to the aryl can have $C_1$-$C_7$alkyl chain. The compounds of formula (A) are preferably linear compounds although branched compounds are not excluded. Particular examples include $C_3F_3H_2Cl$ (such as hydrochlorofluoroolefin 1233zd(Z) and hydrochlorofluoroolefin 1233zd(E)), $CF_3CF{=}CFCF_2CF_2Cl$ and $CF_3CCl{=}CFCF_2CF_3$, and mixtures.

Applicants have found that in certain preferred embodiments the solvent component of the present compositions comprise one or more C3 to C6 fluorakenes, and more preferably one or more C3, C4, or C5 fluoroalkenes, preferably compounds having Formula B as follows:

$$XCF_zR_{3-z} \quad (B)$$

where X is a $C_2$, $C_3$, $C_4$ or $C_5$ unsaturated, substituted or unsubstituted, radical, each R is independently Cl, F, Br, I or H, and z is 1 to 3. In certain preferred embodiments, the fluoroalkene of the present invention has at least four (4) halogen substituents, at least three of which are F and even more preferably none of which are Br. In certain preferred embodiments, the compound of formula B comprises a compound, and preferably a three carbon compound, in which each non-terminal unsaturated carbon has a fluorine substituent.

In certain embodiments it is highly preferred that the compounds of Formula B comprise propenes, butenes, pentenes and hexenes having from 3 to 5 fluorine substituents, with other substituents being either present or not present. In certain preferred embodiments, no R is Br, and preferably the unsaturated radical contains no Br substituents. Among the propenes, tetrafluoropropenes (HFO-1234) and fluorochloroporpenes (such as trifluoro,monochloropropenes (HFCO-1233), and even more preferably $CF_3CCl{=}CH_2$ (HFO-1233xf) and $CF_3CH{=}CHCl$ (HFO-1233zd)) are especially preferred in certain embodiments.

In certain embodiments, pentafluoropropenes are preferred, including particularly those pentafluoropropenes in which there is a hydrogen substituent on the terminal unsaturated carbon, such as $CF_3CF{=}CFH$ (HFO-1225yez and/or yz), particularly since applicants have discovered that such compounds have a relatively low degree of toxicity in comparison to at least the compound $CF_3CH{=}CF_2$ (HFO-1225zc).

Among the butenes, fluorochlorobutenes are especially preferred in certain embodiments.

The term "HFO-1234" is used herein to refer to all tetrafluoropropenes. Among the tetrafluoropropenes are included 1,1,1,2-tetrafluoropropene (HFO-1234yf) and both cis- and trans-1,1,1,3-tetrafluoropropene (HFO-1234ze). The term HFO-1234ze is used herein generically to refer to 1,1,1,3-tetrafluoropropene, independent of whether it is the cis- or trans-form. The terms "cisHFO-1234ze" and "transHFO-1234ze" are used herein to describe the cis- and trans-forms of 1,1,1,3-tetrafluoropropene respectively. The term "HFO-1234ze" therefore includes within its scope cisHFO-1234ze, transHFO-1234ze, and all combinations and mixtures of these.

The term "HFO-1233" is used herein to refer to all trifluoro,monochloropropenes. Among the trifluoro,monochloropropenes are included 1,1,1,trifluoro-2,chloro-propene (HFCO-1233xf), both cis- and trans-1,1,1-trifluo-3,chlororopropene (HFCO-1233zd). The term HFCO-1233zd is used herein generically to refer to 1,1,1-trifluo-3,chloro-propene, independent of whether it is the cis- or trans-form. The terms "cisHFCO-1233zd" and "transHFCO-1233zd" are used herein to describe the cis- and trans-forms of 1,1,1-trifluo,3-chlororopropene, respectively. The term "HFCO-1233zd" therefore includes within its scope cisHFCO-1233zd, transHFCO-1233zd, and all combinations and mixtures of these.

The term "HFO-1225" is used herein to refer to all pentafluoropropenes. Among such molecules are included 1,1,1,2,3 pentafluoropropene (HFO-1225yez), both cis- and transforms thereof. The term HFO-1225yez is thus used herein generically to refer to 1,1,1,2,3 pentafluoropropene, independent of whether it is the cis- or trans-form. The term "HFO-1225yez" therefore includes within its scope cisHFO-1225yez, transHFO-1225yez, and all combinations and mixtures of these.

In certain preferred embodiments, the present compositions comprise a combination of two or more compounds of Formula B. In one such preferred embodiments the composition comprises at least one trifluoro,monochloropropene, preferably HCFO-1233zd, and even more preferably transHCFO-1233zd and at least one tetra- or pentafluoropropene compound, preferably with each compound being present in the composition in an amount of from about 20% by weight to about 80% by weight, more preferably from about 30% by weight to about 70% by weight, and even more preferably from about 40% by weight to about 60% by weight.

The present invention provides also methods and systems which utilize the compositions of the present invention in connection with foam blowing, solvating, flavor and fragrance extraction and/or delivery, aerosol generation, non-aerosol propellants and as inflating agents.

The surfactant functions primarily to reduce the amount of water in the surface of the article to be dried. The hydrochlorofluoro-olefin or hydrofluoro-olefin solvent primarily functions to clean the article, including removal of excess surfactant, and to displace any remaining water from the surface of the article. The amounts of hydrochlorofluoro-olefin or hydrofluoro-olefin and surfactant used may vary widely depending on the application, but are readily apparent to those skilled in the art. U.S. Pat. Nos. 4,438,026 and 4,401,584, incorporated herein in their entireties, disclose the proportions in which such materials may be combined.

The amount of solvent used is an amount sufficient to remove surfactant from the surface of the substrate to be dried. By effective amount of surfactant is meant an amount that is needed for the drying, dry cleaning, or soil repellency capability of the hydrochlorofluoro-olefin or hydrofluoro-olefin to any extent.

Preferably, the amount of surfactant used will be no greater than about 5 weight percent of the total weight of the solvent-surfactant composition. However, although uneconomical, large amounts may be used if after treatment with the composition, the article being dried is treated with a volatile halocarbon having either no or a small amount of surfactant. More preferably, the amount of surfactant is about 0.005 to about 3.0, still more preferably about 0.005 to about 0.5, most preferably about 0.05 to about 0.3, weight percent. In a preferred embodiment for drying applications, the amount of surfactant is at least about 0.005 weight percent, more preferably about 0.005 to about 0.5, most preferably about 0.01 to about 0.2, weight percent. In a preferred embodiment for dry cleaning applications, about 0.005 to about 3.0, more preferably about 0.01 to about 0.5 weight percent is used.

In certain embodiments, the solvent portion of the composition comprises, in an amount of at least about 50% by weight based on the weight of the total weight of the solvent in the composition, trifluoro,monochloropropene, preferably HCFO-1233zd, and even more preferably transHCFO-1233zd. The following Table 1 provides specific examples of solvent/surfactant compositions and preferred and more preferred ranges for compositions comprising at least about 50%, more preferably at least about 75%, and even more preferably at least about 95% by weight, based on the total weight of the solvent and the surfactant in the composition, of transHCFO-1233zd:

TABLE 1

COMPOSITIONS BASED ON TransHCFO-1233zd

| SURFACTANT | WT % IN COMPOSITION-RANGE 1* | WT % IN COMPOSITION-RANGE 2* | WT % IN COMPOSITION-RANGE 3* |
|---|---|---|---|
| Formula I | 0.005 to 3.0 | 0.005 to 0.5 | 0.01 to 0.2 |
| Formula II | 0.005 to 3.0 | 0.005 to 0.5 | 0.01 to 0.2 |
| Formula I, with m on average about 4** | 0.005 to 3.0 | 0.005 to 0.5 | 0.01 to 0.2 |
| Formula I, with m on average about 6** | 0.005 to 3.0 | 0.005 to 0.5 | 0.01 to 0.2 |
| Formula I, with m on average about 8** | 0.005 to 3.0 | 0.005 to 0.5 | 0.01 to 0.2 |
| Formula I, with m on average about 10** | 0.005 to 3.0 | 0.005 to 0.5 | 0.01 to 0.2 |
| Formula I, with m on average about 12** | 0.005 to 3.0 | 0.005 to 0.5 | 0.01 to 0.2 |
| Formula II, with m on average about 4** | 0.005 to 3.0 | 0.005 to 0.5 | 0.01 to 0.2 |
| Formula II, with m on average about 6** | 0.005 to 3.0 | 0.005 to 0.5 | 0.01 to 0.2 |
| Formula II, with m on average about 8** | 0.005 to 3.0 | 0.005 to 0.5 | 0.01 to 0.2 |
| Formula II, with m on average about 10** | 0.005 to 3.0 | 0.005 to 0.5 | 0.01 to 0.2 |
| Formula II, with m on average about 12** | 0.005 to 3.0 | 0.005 to 0.5 | 0.01 to 0.2 |
| octylphenyl acid phosphate salt of perfluoroalkyl prydinium | 0.005 to 3.0 | 0.005 to 0.5 | 0.01 to 0.2 |
| dimethylbenzyl 1,1,2,2 tetrahydroperfluorodecylamine salt of 4-tert-octylphenyl (mono- and di-) acid phosphate | 0.005 to 3.0 | 0.005 to 0.5 | 0.01 to 0.2 |
| diethylmethyl 1,1,2,2 tetrahydroperfluorodecylamine salt of 4-tert-octyl(mono- and di-) acid phosphate | 0.005 to 3.0 | 0.005 to 0.5 | 0.01 to 0.2 |

*All amounts understood to be preceded by about, and the wt % is based on the total surfactant and solvent in the composition.
**m refers to the value in $C_mF_{2m+1}$ The following Table 2 provides specific examples of solvent/surfactant compositions and preferred and more preferred ranges for compositions comprising at least about 50%, more preferably at least about 75%, and even more preferably at least about 95% by weight, based on the total weight of the solvent and the surfactant in the composition, of cisHCFO-1233zd:

TABLE 2

| COMPOSITIONS BASED ON CisHCFO-1233zd | | | |
|---|---|---|---|
| SURFACTANT | WT % IN COMPOSITION-RANGE 1* | WT % IN COMPOSITION-RANGE 2* | WT % IN COMPOSITION-RANGE 3* |
| Formula I | 0.005 to 3.0 | 0.005 to 0.5 | 0.01 to 0.2 |
| Formula II | 0.005 to 3.0 | 0.005 to 0.5 | 0.01 to 0.2 |
| Formula I, with m on average about 4** | 0.005 to 3.0 | 0.005 to 0.5 | 0.01 to 0.2 |
| Formula I, with m on average about 6** | 0.005 to 3.0 | 0.005 to 0.5 | 0.01 to 0.2 |
| Formula I, with m on average about 8** | 0.005 to 3.0 | 0.005 to 0.5 | 0.01 to 0.2 |
| Formula I, with m on average about 10** | 0.005 to 3.0 | 0.005 to 0.5 | 0.01 to 0.2 |
| Formula I, with m on average about 12** | 0.005 to 3.0 | 0.005 to 0.5 | 0.01 to 0.2 |
| Formula II, with m on average about 4** | 0.005 to 3.0 | 0.005 to 0.5 | 0.01 to 0.2 |
| Formula II, with m on average about 6** | 0.005 to 3.0 | 0.005 to 0.5 | 0.01 to 0.2 |
| Formula II, with m on average about 8** | 0.005 to 3.0 | 0.005 to 0.5 | 0.01 to 0.2 |
| Formula II, with m on average about 10** | 0.005 to 3.0 | 0.005 to 0.5 | 0.01 to 0.2 |
| Formula II, with m on average about 12** | 0.005 to 3.0 | 0.005 to 0.5 | 0.01 to 0.2 |
| octylphenyl acid phosphate salt of perfluoroalkyl prydinium | 0.005 to 3.0 | 0.005 to 0.5 | 0.01 to 0.2 |
| dimethylbenzyl 1,1,2,2 tetrahydroperfluorodecylamine salt of 4-tert-octylphenyl (mono- and di-) acid phosphate | 0.005 to 3.0 | 0.005 to 0.5 | 0.01 to 0.2 |
| diethylmethyl 1,1,2,2 tetrahydroperfluorodecylamine salt of 4-tert-octyl(mono- and di-) acid phosphate | 0.005 to 3.0 | 0.005 to 0.5 | 0.01 to 0.2 |

*All amounts understood to be preceded by about, and the wt % is based on the total surfactant and solvent in the composition.
**m refers to the value in $C_mF_{2m+1}$ In certain embodiments, the solvent portion of the composition comprises, in an amount of at least about 50% by weight based on the weight of the total weight of the solvent in the composition, tetrafluoropropene, preferably HFO-1234ze, and even more preferably transHFO-1234ze. The following Table 3 provides specific examples of solvent/surfactant compositions and preferred and more preferred ranges for compositions comprising at least about 50%, more preferably at least about 75%, and even more preferably at least about 95% by weight, based on the total weight of the solvent and the surfactant in the composition, of transHFO-1234ze:

TABLE 3

| COMPOSITIONS BASED ON TransHFO-1234ze | | | |
|---|---|---|---|
| SURFACTANT | WT % IN COMPOSITION-RANGE 1* | WT % IN COMPOSITION-RANGE 2* | WT % IN COMPOSITION-RANGE 3* |
| Formula I | 0.005 to 3.0 | 0.005 to 0.5 | 0.01 to 0.2 |
| Formula II | 0.005 to 3.0 | 0.005 to 0.5 | 0.01 to 0.2 |
| Formula I, with m on average about 4** | 0.005 to 3.0 | 0.005 to 0.5 | 0.01 to 0.2 |
| Formula I, with m on average about 6** | 0.005 to 3.0 | 0.005 to 0.5 | 0.01 to 0.2 |
| Formula I, with m on average about 8** | 0.005 to 3.0 | 0.005 to 0.5 | 0.01 to 0.2 |
| Formula I, with m on average about 10** | 0.005 to 3.0 | 0.005 to 0.5 | 0.01 to 0.2 |
| Formula I, with m on average about 12** | 0.005 to 3.0 | 0.005 to 0.5 | 0.01 to 0.2 |
| Formula II, with m on average about 4** | 0.005 to 3.0 | 0.005 to 0.5 | 0.01 to 0.2 |
| Formula II, with m on average about 6** | 0.005 to 3.0 | 0.005 to 0.5 | 0.01 to 0.2 |
| Formula II, with m on average about 8** | 0.005 to 3.0 | 0.005 to 0.5 | 0.01 to 0.2 |

TABLE 3-continued

| COMPOSITIONS BASED ON TransHFO-1234ze | | | |
|---|---|---|---|
| SURFACTANT | WT % IN COMPOSITION-RANGE 1* | WT % IN COMPOSITION-RANGE 2* | WT % IN COMPOSITION-RANGE 3* |
| Formula II, with m on average about 10** | 0.005 to 3.0 | 0.005 to 0.5 | 0.01 to 0.2 |
| Formula II, with m on average about 12** | 0.005 to 3.0 | 0.005 to 0.5 | 0.01 to 0.2 |
| octylphenyl acid phosphate salt of perfluoroalkyl prydinium | 0.005 to 3.0 | 0.005 to 0.5 | 0.01 to 0.2 |
| dimethylbenzyl 1,1,2,2 tetrahydroperfluorodecylamine salt of 4-tert-octylphenyl (mono- and di-) acid phosphate | 0.005 to 3.0 | 0.005 to 0.5 | 0.01 to 0.2 |
| diethylmethyl 1,1,2,2 tetrahydroperfluorodecylamine salt of 4-tert-octyl(mono- and di-) acid phosphate | 0.005 to 3.0 | 0.005 to 0.5 | 0.01 to 0.2 |

*All amounts understood to be preceded by about, and the wt % is based on the total surfactant and solvent in the composition.
**m refers to the value in $C_mF_{2m+1}$ The following Table 4 provides specific examples of solvent/surfactant compositions and preferred and more preferred ranges for compositions comprising at least about 50%, more preferably at least about 75%, and even more preferably at least about 95% by weight, based on the total weight of the solvent and the surfactant in the composition, of cisHFO-1234ze:

TABLE 4

| COMPOSITIONS BASED ON TransHFO-1234ze | | | |
|---|---|---|---|
| SURFACTANT | WT % IN COMPOSITION-RANGE 1* | WT % IN COMPOSITION-RANGE 2* | WT % IN COMPOSITION-RANGE 3* |
| Formula I | 0.005 to 3.0 | 0.005 to 0.5 | 0.01 to 0.2 |
| Formula II | 0.005 to 3.0 | 0.005 to 0.5 | 0.01 to 0.2 |
| Formula I, with m on average about 4** | 0.005 to 3.0 | 0.005 to 0.5 | 0.01 to 0.2 |
| Formula I, with m on average about 6** | 0.005 to 3.0 | 0.005 to 0.5 | 0.01 to 0.2 |
| Formula I, with m on average about 8** | 0.005 to 3.0 | 0.005 to 0.5 | 0.01 to 0.2 |
| Formula I, with m on average about 10** | 0.005 to 3.0 | 0.005 to 0.5 | 0.01 to 0.2 |
| Formula I, with m on average about 12** | 0.005 to 3.0 | 0.005 to 0.5 | 0.01 to 0.2 |
| Formula II, with m on average about 4** | 0.005 to 3.0 | 0.005 to 0.5 | 0.01 to 0.2 |
| Formula II, with m on average about 6** | 0.005 to 3.0 | 0.005 to 0.5 | 0.01 to 0.2 |
| Formula II, with m on average about 8** | 0.005 to 3.0 | 0.005 to 0.5 | 0.01 to 0.2 |
| Formula II, with m on average about 10** | 0.005 to 3.0 | 0.005 to 0.5 | 0.01 to 0.2 |
| Formula II, with m on average about 12** | 0.005 to 3.0 | 0.005 to 0.5 | 0.01 to 0.2 |
| octylphenyl acid phosphate salt of perfluoroalkyl prydinium | 0.005 to 3.0 | 0.005 to 0.5 | 0.01 to 0.2 |
| dimethylbenzyl 1,1,2,2 tetrahydroperfluorodecylamine salt of 4-tert-octylphenyl (mono- and di-) acid phosphate | 0.005 to 3.0 | 0.005 to 0.5 | 0.01 to 0.2 |
| diethylmethyl 1,1,2,2 tetrahydroperfluorodecylamine salt of 4-tert-octyl(mono- and di-) acid phosphate | 0.005 to 3.0 | 0.005 to 0.5 | 0.01 to 0.2 |

*All amounts understood to be preceded by about, and the wt % is based on the total surfactant and solvent in the composition.
**m refers to the value in $C_mF_{2m+1}$ The compositions of the invention may be used to clean and/or dry nonabsorbent substrates and articles constructed of such materials as metals, glasses, ceramics, and the like. Thus, in yet another embodiment, the invention provides a method for drying the surface of a substrate comprising the steps of contacting the substrate with a composition comprising a solvent comprising a hydrochlorofluoro-olefin, hydrofluoro-olefin, or mixtures thereof and effective amounts of a surfactant of the Formula (I) or (II) and then removing the solvent-surfactant composition from the article.

Thus, the invention provides a method for dry cleaning an article which comprises the steps of contacting, or exposing, the article to a composition comprising a solvent comprising a hydrochlorofluoro-olefin, hydrofluoro-olefin, or mixtures thereof and effective amounts of a surfactant of the Formula (I)-(IV) above and then removing the solvent-surfactant composition from the article.

The invention additionally provides a method for imparting soil repellency to a fabric comprising the steps of contacting, or exposing, the fabric to a composition comprising a solvent comprising a hydrochlorofluoro-olefin, hydrofluoro-olefin, or mixtures thereof and an effective amount of a surfactant of the Formulae (I)-(IV) and removing the solvent from the fabric.

The manner of contacting is not critical and may vary widely. For example, the article may be immersed in a container of the composition or the article may be sprayed with the composition. Complete immersion of the article is preferred because it ensures contact between all exposed surfaces of the article and the composition. Any method that can provide such contact may be used. Typically, the contacting time is up to about 10 minutes, but this time is not critical and longer times may be used if desired.

The contacting temperature may also vary widely depending on the boiling point of the compositions. In general, the temperature is equal to or less than about such boiling point. Following the contacting step, the article is removed from contact with the composition and removal of composition adhering to exposed surfaces of the article is effected by any conventional means such as evaporation. Optionally, the remaining minimal amounts of surfactant adhering to the article may be removed further by contacting the article with surfactant free solvent that is hot or cold. Finally, holding the article in the solvent vapor will decrease further the presence of the surfactant residue remaining on the article. Again, removal of solvent adhering to the article is effected by evaporation.

In general, removal, or evaporation, of the composition is effected in less than about 30 seconds, preferably less than about 10 seconds. Neither temperature nor pressure is critical. Atmospheric or sub-atmospheric pressure may be employed and temperatures above and below the boiling point of the hydrochlorofluoro-olefin or hydrofluoroolefin may be used. Optionally, additional surfactants may be included in the overall composition as desired.

In yet another embodiment, a substrate is provided with a coating of the surfactant of the invention in an amount effective to provide the fabric with soil repellent characteristics.

This may be accomplished by dissolving the surfactant in hydrochlorofluoro-olefin, hydrofluoro-olefin, or mixtures thereof. The substrate is then wetted with the composition by spraying (aerosol or pump) or immersion for a length of time sufficient to cause the composition to be imbibed by the substrate. Moreover, the surfactant may enhance the removal of solids from the substrate by contacting the soiled substrate with the solvent-surfactant compositions. This method will likely find its greatest utility in cases in which the substrate is a fabric.

Two or more hydrochlorofluoro-olefin or hydrofluoro-olefin solvents may be used.

Alternatively, instead of a surfactant, a second solvent may be included such as an alcohol. Preferably this solvent is methanol, ethanol, or isopropanol. The use of this second solvent with hydrochlorofluoro-olefin or hydrofluoro-olefin may be used in the same drying and dry cleaning, discussed above. For a soil repellency application, one or more hydrochlorofluoro-olefin or hydrofluoro-olefin solvents of the invention in combination with one or more alcohols can be used to effectively dissolve a surfactant and then deliver it to a fabric using a process such as spray or immersion application as discussed above.

When a second solvent is used, the second solvent is present in amounts of from about 1 to about 50 weight percent, preferably from about 4 to about 45 percent, based on the total composition.

When using a surfactant-solvent combination, it is noted that in drying, dry cleaning, and soil repellency (as a result of dry cleaning where a surfactant is present) or by direct application of the surfactant as a soil repellent—some amount of surfactant remains, for example, after drying of solid substrates. Typically this remaining surfactant is a mono-molecular layer of surfactant.

The compositions and processes of the invention are preferably carried out or used with conventional drying or dry cleaning machines and systems. Illustrative of such drying machines are those described in U.S. Pat. No. 3,386,181, which is hereby incorporated in its entirety by reference.

EXAMPLES

Example 1

The performance of the solvent-surfactant composition of the invention in the displacement of water was evaluated by placing 35 mL of the solvent 1-chloro-3,3,3trifluoro-I-propene containing 500 ppm by weight of octylphenyl acid phosphate salt of perfluoroalkyl prydinium (the surfactant prepared in Example 2 of 5,856,286) in a 100 mL beaker fitted with a cooling coil. The solution was brought to a boil whereby the coiling coil confined the solvent vapor to the beaker. Duplicate 316 stainless steel coupons, wet-abraded to a water-break-free condition, were immersed in water and then into the boiling sample solution. The time required to displace the water from the coupon was recorded, a minimum observation time of 5 second was chosen.

After an initial observation of drying performance, 35 mL of water was added to the boiling solution. The solution was kept boiling for 5 minutes in order to provide contact between the solution and the water. The mixture was then transferred to a separatory funnel and the time for phase separation was noted. Rapid separation into clear phases with no emulsion layer was an indication that the solution will perform successfully in the application. A clear water phase indicated that no gross loss of drying solvent to the water effluent of a commercial machine would be expected. In this test, a clear solvent phase indicated the ability of the drying solvent to expel displaced water from a drying machine in a particle time frame, i.e., water will not accumulate in the solvent phase.

The results demonstrated that the octylphenyl acid phosphate salt of perfluoroalkyl prydinium telomer performed as an active surfactant for water displacement with respect to drying time, phase separation, phase clarity, and for HFCO solvent at the 500 ppm level.

Example 2

The performance of a solvent-solvent composition of the invention in the displacement of water is evaluated by placing 35 mL of I-chloro-3,3,3-trifluoro-lpropene solvent containing 5% by weight methanol solvent in a 100 mL beaker fitted with a cooling coil. The solution is brought to a boil whereby the coiling coilconfines the solvent vapor to the beaker. Duplicate 316 stainless steel coupons, wetabraded to a water-break-free condition, are immersed in water and then into the boiling sample solution. The time required to displace the water from the coupon is recorded using a minimum observation time of 5 seconds. The solvent alcohol blend could remove water completely from the substrate.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A composition comprising effective amounts of at least one hydrofluoro-olefin or hydrochlorofluoro-olefin solvent and at least one, hydrophobic, fluorine-containing surfactant soluble in the hydrofluoro-olefin or hydrochlorofluoro-olefin solvent, wherein the surfactant comprises formula I or formula II:

I

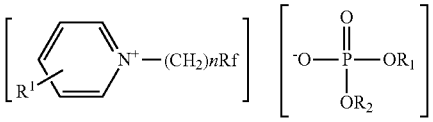

II

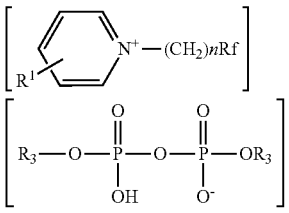

wherein $R_1$ is hydrogen, $C_1$-$C_5$ alkyl, aryl, alkylaryl, $C_1$-$C_5$ fluoroalkyl, fluoroaryl, or fluoroalkylaryl, $R_1$, $R_2$ and $R_3$ may be the same or different and are hydrogen, linear or branched $C_1$-$C_{16}$ alkyl, fluoroalkyl, aryl or alkylaryl or

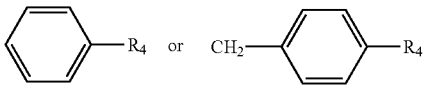

wherein $R_4$ is a linear or branched $C_1$-$C_{16}$ alkyl or fluoroalkyl group, provided that not more than one of the $R_1$, $R_2$, and $R_3$ groups is hydrogen, n is 1 to 16, and Rf is $C_mF_{2m+1}$ wherein m is 2, 4, 6, 8, 10 or 12 or mixtures of such surfactant compositions.

2. The composition of claim 1 wherein n is 2, 3 or 4.

3. The composition of claim 1 wherein n=2 and Rf is alphafluoropolydifluoromethylene with an average m value of about 6-8.

4. The composition of claim 1 wherein the surfactant is an oligomeric perfluoroalkylpyridinium salt of 4-tert-octylphenyl-monoacid phosphates, an oligomeric perfluoroalkylpyridinium salt of 4-tert-octylphenyl-diacid phosphates, or mixtures thereof.

5. A composition comprising effective amounts of at least one hydrofluoro-olefin or hydrochlorofluoro-olefin solvent and at least one, hydrophobic, fluorine-containing surfactant soluble in the hydrofluoro-olefin or hydrochlorofluoro-olefin solvent, wherein the surfactant comprises formula III or formula IV:

III

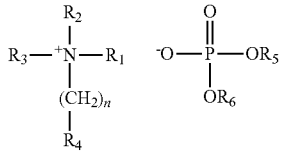

IV

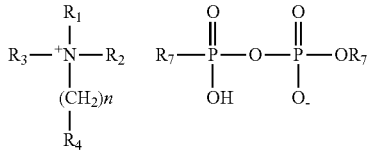

wherein $R_1$, $R_2$, $R_3$, can be the same or different and are linear or branched $C_1$ to $C_{16}$ alkyl, fluoroalkyl, alkylaryl or

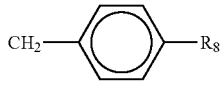

where $R_8$ is hydrogen or a linear or branched $C_1$ to $C_{16}$ alkyl or fluoroalkyl group; $R_4$ is $C_1$ to $C_{18}$ perfluoroalkyl; n is from 1 to 4; $R_5$, $R_6$ and $R_7$ can be the same or different and are H, linear or branched $C_1$ to $C_{16}$ alkyl, fluoroalkyl or alkylaryl group

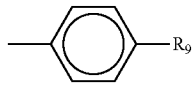

or where $R_9$ is a linear or branched a $C_1$ to $C_{16}$ alkyl or fluoroalkyl group provided not more than one of $R_5$, $R_6$ and $R_7$ is H, and mixtures of such surfactants.

6. The composition of claim 5 wherein the surfactant is selected from the group consisting of the diethyl methyl 1,1,2,2-tetrahydroperfluorodecylamine salt of octylphenyl (mono)acid phosphate, the diethyl methyl 1,1,2,2-tetrahydroperfluorodecylamine salt of octylphenyl (di)acid phosphate; the dimethyl benzyl 1,1,2,2-tetrahydroperfluorodecylamine salt of octyl phenyl (mono) acid phosphate and the dimethyl benzyl 1,1,2,2tetrahydroperfluorodecylamine salt of octyl phenyl (di) acid phosphate; the diethyl benzyl 1,1,2,2-tetrahydroperfluorodecylamine salt of octyl phenyl (mono) acid phosphate and the diethyl benzyl 1,1,2,2-tetrahydroperfluorodecylamine salt of octyl phenyl (di) acid phosphate.

7. The composition of claim 5 which is the diethyl methyl 1,1,2,2-tetrahydroperfluorodecylamine salt of octyl phenyl acid phosphate or the dimethyl benzyl 1,1,2,2-tetrahydroperfluorodecylamine salt of octyl phenyl acid phosphate.

8. The composition of claim 5 which is a diethyl methyl amine salt and wherein $R_4$ is $C_8$ to $C_{16}$.

9. The composition of claim 5 which is a dimethyl benzyl amine salt and wherein $R_4$ is $C_8$ to $C_{16}$.

10. The composition of claim 1 wherein the hydrofluoroolefin or hydrochlorofluoroolefin has the structure of formula (A):

A

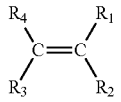

wherein $R_1$, $R_2$, $R_3$, and $R_4$ are each independently selected from the group consisting of: H, F, Cl, and $C_1$-C alkyl, at least $C_6$ aryl, at least $C_3$ cycloalkyl, and $C_6$-$C_{15}$ alkylaryl, optionally substituted with at least one F or, wherein formula (A) contains at least one F.

11. The composition of claim 10 comprising 1-chloro-3,3,3-trifluoro-1-propene as the hydrochlorofluoro-olefin solvent.

12. A method for drying the surface of a substrate comprising the steps of contacting the substrate with the solvent-surfactant composition of claim 1 and then removing the solvent surfactant composition from the article.

13. A method for dry cleaning an article which comprises the steps of contacting the article to the solvent-surfactant composition of claim 1 and then removing the solvent surfactant composition from the article.

14. A method for imparting soil repellency to a fabric comprising the steps of contacting, or exposing, the fabric to the solvent-surfactant composition of claim 1 and the removing the solvent from the fabric.

15. A method for imparting soil repellency to a fabric comprising the steps of contacting, or exposing, the fabric to the surfactant of claim 1 and a composition comprising effective amounts of at least one hydrofluoro-olefin or hydrochlorofluoro-olefin and at least one solvent selected from alcohols, and then removing the composition to leave the surfactant on the surface of the fabric.

16. A method for drying the surface of a substrate comprising the steps of contacting the substrate with the solvent-surfactant composition of claim 5 and then removing the solvent surfactant composition from the article.

17. A method for dry cleaning an article which comprises the steps of contacting the article to the solvent-surfactant composition of claim 5 and then removing the solvent surfactant composition from the article.

18. A method for imparting soil repellency to a fabric comprising the steps of contacting, or exposing, the fabric to the solvent-surfactant composition of claim 5 and the removing the solvent from the fabric.

19. A method for drying the surface of a substrate comprising the steps of contacting the substrate with the solvent-surfactant composition of claim 10 and then removing the solvent surfactant composition from the article.

20. A method for dry cleaning an article which comprises the steps of contacting the article to the solvent-surfactant composition of claim 10 and then removing the solvent surfactant composition from the article.

21. A method for imparting soil repellency to a fabric comprising the steps of contacting, or exposing, the fabric to the solvent-surfactant composition of claim 10 and the removing the solvent from the fabric.

22. A method for imparting soil repellency to a fabric comprising the steps of contacting, or exposing, the fabric to the surfactant of claim 5 and a composition comprising effective amounts of at least one hydrofluoro-olefin or hydrochlorofluoroolefin and at least one solvent selected from alcohols, and then removing the composition to leave the surfactant on the surface of the fabric.

23. The composition of claim 5 wherein the hydrofluoroolefin or hydrochlorofluoroolefin has the structure of formula (A):

A

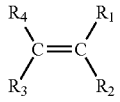

wherein R1, R2, R3, and R4 are each independently selected from the group consisting of: H, F, Cl, and C1-C6 alkyl, at least C6 aryl, at least C3 cycloalkyl, and C6-C15 alkylaryl, optionally substituted with at least one F or Cl, wherein formula (A) contains at least one F.

* * * * *